US009867515B2

(12) United States Patent
Ventress et al.

(10) Patent No.: US 9,867,515 B2
(45) Date of Patent: Jan. 16, 2018

(54) CLEANER HEAD

(71) Applicant: Dyson Technology Limited, Wiltshire (GB)

(72) Inventors: Sean Ventress, Bristol (GB); Louis Peter Richard Garner, Dorchester (GB)

(73) Assignee: DYSON TECHNOLOGY LIMITED, Malmesbury, Wiltshire (GB)

( * ) Notice: Subject to any disclaimer, the term of this patent is extended or adjusted under 35 U.S.C. 154(b) by 206 days.

(21) Appl. No.: 14/842,487

(22) Filed: Sep. 1, 2015

(65) Prior Publication Data

US 2016/0058257 A1 Mar. 3, 2016

(30) Foreign Application Priority Data

Sep. 2, 2014 (GB) ..... 1415493.4

(51) Int. Cl.
*A47L 9/04* (2006.01)
*A47L 9/06* (2006.01)

(52) U.S. Cl.
CPC ..... *A47L 9/0477* (2013.01); *A47L 9/0488* (2013.01); *A47L 9/0626* (2013.01)

(58) Field of Classification Search
CPC .... A47L 9/0477; A47L 9/0488; A47L 9/0626; A47L 5/30; A47L 9/041
See application file for complete search history.

(56) References Cited

U.S. PATENT DOCUMENTS

| | | | | |
|---|---|---|---|---|
| 2,642,617 A * | 6/1953 | Lilly | A47L 11/33 15/360 |
| 2,960,714 A * | 11/1960 | Senne | A47L 9/04 15/328 |
| 2006/0162121 A1* | 7/2006 | Naito | A47L 9/02 15/416 |
| 2009/0229075 A1 | 9/2009 | Eriksson | |

FOREIGN PATENT DOCUMENTS

| | | |
|---|---|---|
| FR | 2999067 | 6/2014 |
| GB | 2 348 598 | 10/2000 |
| JP | 5-305044 | 11/1993 |
| JP | 6-86743 | 3/1994 |
| JP | 10-33424 | 2/1998 |

(Continued)

OTHER PUBLICATIONS

Search Report dated Feb. 26, 2015, directed to GB Application No. 1415493.4; 1 page.

(Continued)

*Primary Examiner* — Robert Scruggs
(74) *Attorney, Agent, or Firm* — Morrison & Foerster LLP

(57) ABSTRACT

A cleaner head for a cleaning appliance, comprising a brushbar, a housing defining a chamber which at least partially surrounds the brushbar, the chamber having a dirty air inlet and a dirty air outlet, and a scraper having a working edge which extends in the longitudinal direction of the brushbar. The scraper is arranged such that, in use, the working edge scrapes debris entrained by the brushbar from the brushbar. The working edge has a profile which is shaped such that debris which accumulates at the working edge is drawn by the airflow through the cleaner head along the working edge towards the dirty air outlet.

15 Claims, 5 Drawing Sheets

(56) References Cited

FOREIGN PATENT DOCUMENTS

| | | |
|---|---|---|
| JP | 2000-287894 | 10/2000 |
| JP | 2009-82289 | 4/2009 |
| JP | 2010-63624 | 3/2010 |
| JP | 2014-87385 | 5/2014 |

OTHER PUBLICATIONS

International Search Report and Written Opinion dated Oct. 27, 2015, directed towards International Application No. PCT/GB2015/052428; 12 pages.

* cited by examiner

CLEANER HEAD

REFERENCE TO RELATED APPLICATIONS

This application claims priority to United Kingdom Application No. 1415493.4, filed Sep. 2, 2014, the entire contents of which are incorporated herein by reference.

FIELD OF THE INVENTION

This invention relates to a cleaner head for a cleaning appliance and particularly, although not exclusively, relates to a cleaner head for a vacuum cleaner, such as a vacuum cleaner for domestic use.

BACKGROUND OF THE INVENTION

Cleaner heads for vacuum cleaning appliances often comprise a rotatable brushbar for improving debris pickup from carpets.

Types of debris picked up during cleaning include dust, dirt, food particles and hair Fluff and bundles of hair can be problematic because they can become stuck on the bristles of the brushbar or trapped within the cleaner head.

SUMMARY OF THE INVENTION

According to a first aspect of the present invention there is provided a cleaner head for a cleaning appliance, comprising a brushbar, a housing defining a chamber which at least partially surrounds the brushbar, the chamber having a dirty air inlet and a dirty air outlet, and a scraper having a working edge which extends in the longitudinal direction of the brushbar, the scraper is arranged such that, as the brushbar rotates, the working edge scrapes debris entrained by the brushbar from the brushbar, wherein the working edge has a profile which is shaped such that debris which accumulates at the working edge is drawn by the airflow through the cleaner head along the working edge towards the dirty air outlet.

The scraper may extend in a generally downward direction within the housing such that the working edge forms a lower edge of the scraper.

The scraper may be inclined downwardly and forwardly within the housing.

The dirty air outlet may extend in a plane which extends transversely with respect to the cleaner head. The distance of the working edge from the plane in a direction which is perpendicular to the plane may vary along the working edge. The transverse direction of the cleaner head is the direction perpendicular to the normal direction in which the cleaner head is moved across a surface being cleaned.

The distance of the working edge from the plane increases along the working edge with respect to a direction which extends away from the dirty air outlet.

The working edge may be inclined with respect to the plane in which the dirty air outlet extends.

The working edge may follow a straight line. Alternatively, the working edge may follow a curved line.

The working edge is arranged such that, when the cleaner head is placed on a flat surface to be cleaned, the distance of the working edge from the surface in a direction which is perpendicular to the surface varies along the working edge. The arrangement would be particularly effective where the dirty air outlet is provided in an upper portion of the housing.

The dirty air outlet may be positioned centrally with respect to the transverse direction of the cleaner head. The scraper may be positioned rearwardly of the brushbar. The scraper may be rigid.

The scraper may extend in a plane which is tangential to the brushbar. The scraper may be arranged such that the working edge opposes the direction of rotation of the brushbar.

According to a second aspect of the invention there is provide a cleaning appliance comprising a cleaner head which is in accordance with the first aspect of the invention.

BRIEF DESCRIPTION OF THE DRAWINGS

In order to better understand the present invention, and to show more clearly how the invention may be put into effect, the invention will now be described, by way of example, with reference to the following drawings.

DETAILED DESCRIPTION OF THE INVENTION

Figure 1:
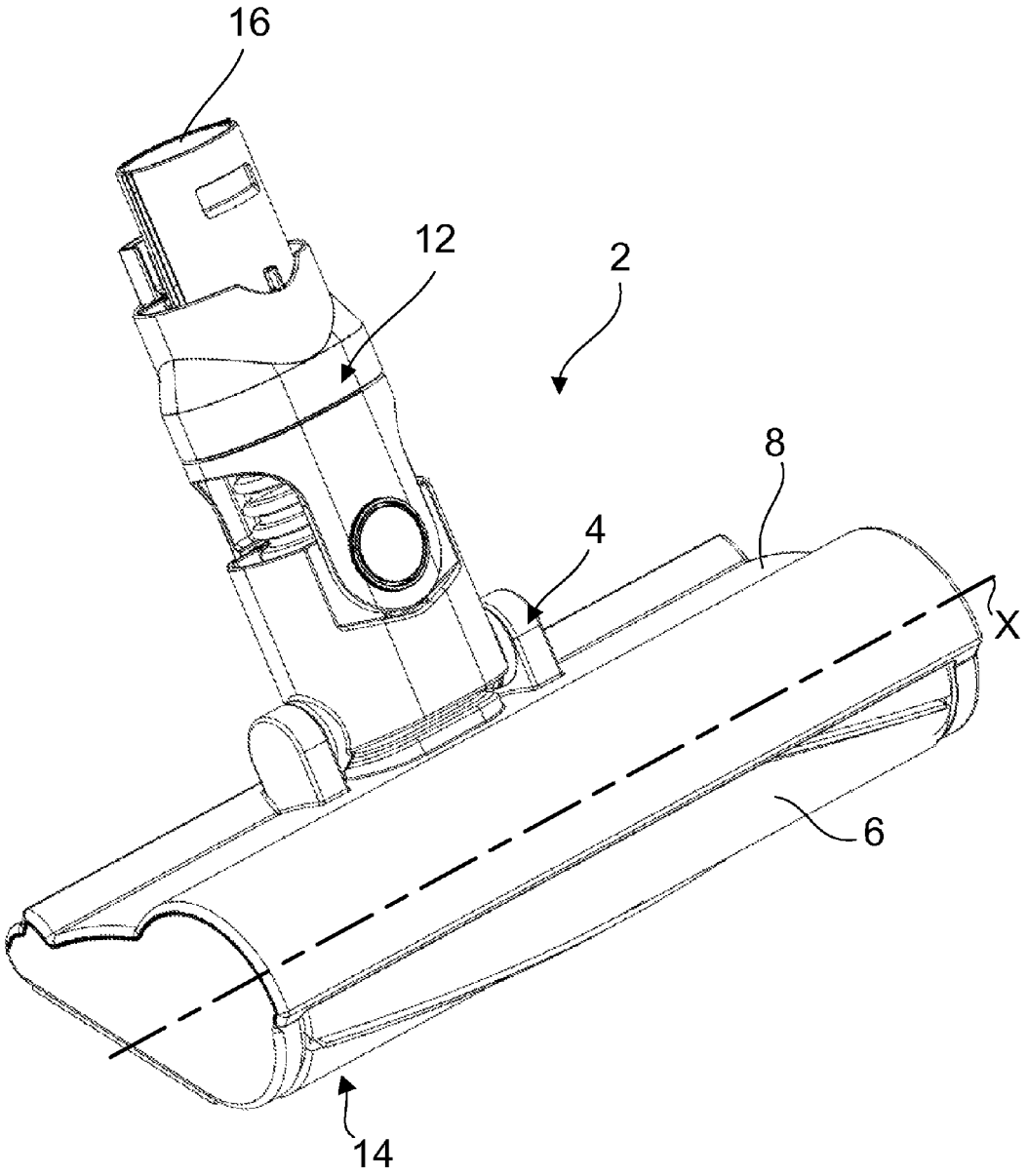
FIG. 1 is a perspective view of a cleaner head for a cleaning appliance.

FIGS. 1 to 4 show a cleaner head 2 comprising a main body 4 and an agitator in the form of a brushbar 6 supported for rotation by the main body 4. The brushbar 6 has a rotational axis X. The main body 4 comprises a housing 8 having a chamber 10 (shown in FIG. 3), within which the brushbar 6 is disposed, and an articulated neck 12 which is pivotally connected to the housing 8.

The housing 8 has an inlet opening 14 which extends across the underside and the front of the housing 8. The brushbar 6 is exposed through the opening 14. The inlet opening 14 provides an inlet to the cleaner head 2 through which air is drawn during use.

The articulated neck 12 comprises an outlet opening 16 at the end not connected to the housing 8. The outlet opening 16 provides an outlet from the cleaner head 2. The articulated neck 12 is connectable to a separator of a vacuum cleaner (not shown) either directly or via a wand or hose, for example.

Figure 2:
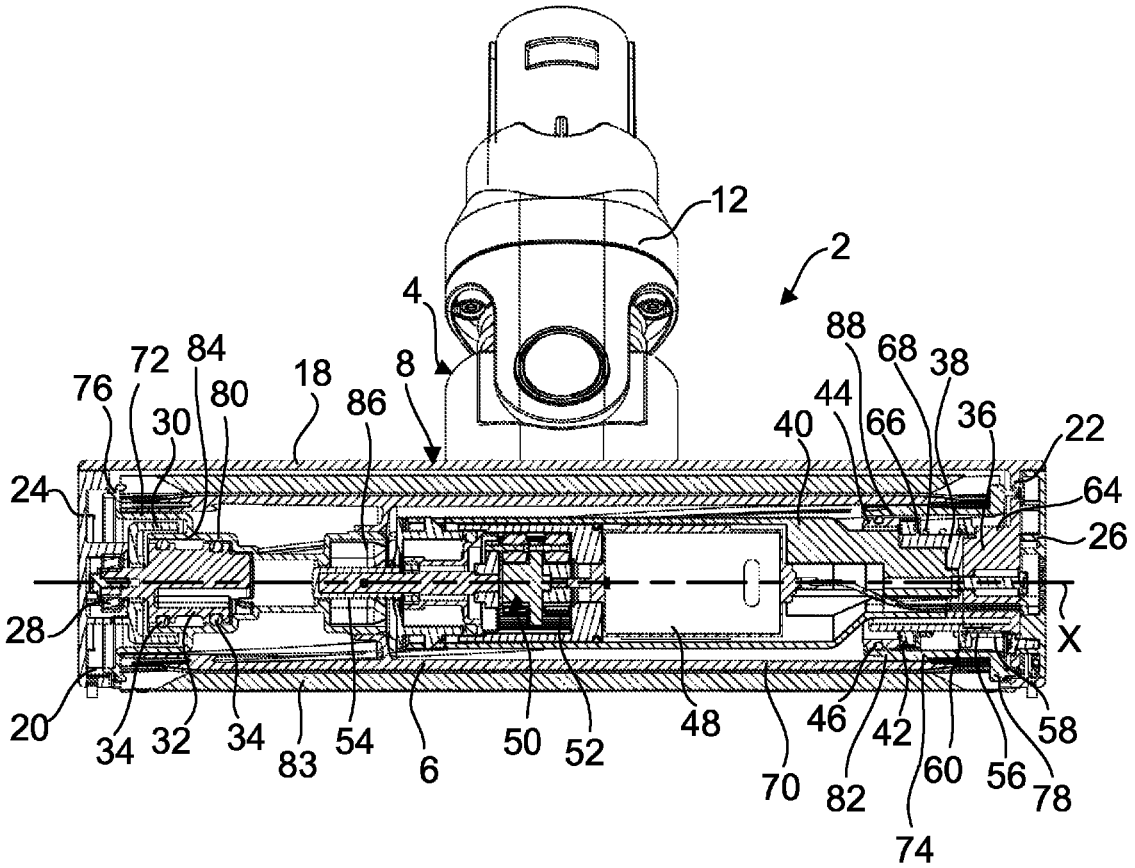
FIG. 2 is a sectional view of the cleaner head shown in FIG. 1.

FIG. 2 is a sectional view of the cleaner head 2 along the rotational axis X of the brushbar 6.

The housing 8 comprises a top portion 18 and first and second side portions 20, 22 which define the chamber 10 within which the brushbar 6 is located. Each side portion 20, 22 is provided, respectively, with first and second end caps 24, 26. The first end cap 24 is removable from the first side portion 20.

The first end cap 24, which engages with the first side portion 20, supports a first bearing 28, for example a roller bearing. The first bearing 28 secured to the first end cap 24 by a bearing retainer 30. The first bearing 28 supports a first brushbar mount 32 for rotation with respect to the first end cap 24. The first brushbar mount 32 projects into the chamber 10 and is provided with seals 34, in the form of o-rings, on an outer surface of the brushbar mount 32.

The second side portion 22 is covered by the second end cap 26. The second side portion 22 comprises a mounting portion 36, part of which projects into the chamber 10. A drive housing mount 38 is secured to the mounting portion 36. The drive housing mount 38 is substantially cylindrical. The drive housing mount 38 supports an elongate drive housing 40 which extends from the drive housing mount 38 further into the chamber 10 along the rotational axis X. A second bearing 42, such as a roller bearing, is supported by the drive housing mount 38. The second bearing 42 extends circumferentially about an outer surface of the drive housing mount 38. The second bearing 42 supports a second brushbar mount 44 for rotation with respect to the drive housing mount 38. The second brushbar mount 44 is provided with a seal 46, in the form of an o-ring, on an outer surface of the second brushbar mount 44.

The drive housing 40 houses a brushbar motor (only the casing 48 for which is shown) and a transmission 50. The transmission 50 comprises a gear arrangement 52 and a drive dog 54. The drive dog 54 protrudes from the end of the drive housing 40 opposite the drive housing mount 38.

A collector in the form of a spool 56 is mounted on the mounting portion 36 between the second bearing 42 and the second side portion 22 of the housing 8. The spool 56 is cylindrical and comprises an outer surface 58 for collecting strands of hair and a circumferential rib 60 at one end for preventing strands of hair that have collected on the outer surface 58 from sliding off the spool 56. In particular, the rib 60 helps prevent hair from getting tangled with the second bearing 42 or the brushbar motor.

The spool 56 is slidably mounted on the mounting portion 36 so that it can slide from a hair collecting position in which the spool 56 abuts the second side portion 22 and a hair removal position in which the spool 56 is spaced from the second side portion 22.

The spool 56 is provided with slots 62 (see FIG. 3) that engage with ribs 64 provided on the mounting portion 36. The ribs 64 prevent rotation of the spool 56 when the spool 56 is in the collecting position.

An abutment feature in the form of a circumferential rib 66 is provided on the drive housing mount 38. A biasing device in the form of a compression spring 68 is disposed between the rib 66 and the spool 56. One end of the spring 68 abuts the rib 66 and the other end of the spring 68 abuts the spool 56. The spring 68 biases the spool 56 into the collecting position and holds the spool 56 firmly against the second side portion 22 of the housing 8. The rib 66 provides a second function of holding the second bearing 42 in position on the drive housing mount 38.

The brushbar 6 comprises a hollow cylindrical body 70 and first and second end plugs 72, 74 disposed respectively at each of the ends of the cylindrical body 70. Each end plug 72, 74 has a flange 76, 78, which abuts a respective end of the cylindrical body 70, and a substantially cylindrical portion 80, 82 which protrudes from the flange 76, 78 into the cylindrical body 70. Bristles 83, which are arranged in circumferentially spaced strips, extend radially outwardly from the cylindrical body 70.

The end of the first plug 72 having the flange 76 is open so that the first brushbar mount 32 can be inserted into the first plug 72. The internal surface of the first plug 72 is contoured, and converges in progressive stepped portions. One of the stepped portions provides a sealing surface 84 against which the seals 34, provided on the first brushbar mount 32, seal. The first plug 72 has a socket 86 at the end of the plug 72 opposite the flange 76. The socket 86 is configured to slidably receive the drive dog 54. The first plug 72 is secured for rotation with the cylindrical body 70.

The second plug 74 is open at both ends so that the mounting portion 36, drive housing mount 38, drive housing 40, second bearing 42 and second brushbar mount 44 assembly, which forms an axle on which the brushbar 6 is supported, can pass through the open ends into the cylindrical body 70. The second plug 74 is secured for rotation with the cylindrical body 70. The second plug 74 has an internal sealing surface 88 against which the seal 46, which is provided on the second brushbar mount 44, seals.

During use, air is drawn in through the inlet opening 14, past the brushbar 6 and out through the outlet opening 16 to the separator of the vacuum cleaner to which the cleaner head 2 is connected. The brushbar motor, which in the embodiment shown is powered by a power source external to the cleaner head 2, drives the brushbar 6 in rotation via the transmission 50. In particular, the brushbar motor drives the gear arrangement 52, which drives the drive dog 54. The drive dog 54, which is received by the socket 86, drives the first plug 72 and hence the brushbar 6 to rotate within the chamber 10.

The rotating brushbar 6 agitates debris located on a surface being cleaned, for example debris located between carpet fibres. During cleaning, strands of hair (or other long fibres, such as cotton threads, ribbon etc) may be picked up by the brushbar 6. Although most strands of hair will be drawn out through the outlet opening 16 to the separator, some will wrap around the brushbar and become trapped. Furthermore, it is expected that strands of hair will work their way over the ends of the brushbar 6 through the gaps between the flanges 76, 78 and the first and second side portions 20, 22 of the housing 8. Hair strands which find their way between the gap between the flange 78 of the second plug 74 are wrapped about the outer surface 58 of the spool 56 by rotation of the brushbar 6.

The strands of hair collect as a bale around the outer surface 58 of the spool 56. The rib 60 together with the second side portion 22 prevent the hair from slipping from the spool 56. As hair accumulates, the thickness of the bail increases until it presses against a region of the inner surface of the second plug 74 which is adjacent the flange 78. The spool 56 is held rotationally fixed with respect to the mounting portion 36 by engagement of the slots 62 provided in the spool 56 with the ribs 64 on the mounting portion 36. Consequently, the region of the inner surface of the second plug 74 against which the hair presses forms a braking surface which exerts a braking torque on the brushbar 6. The braking torque exerted on the brushbar 6 increases as the quantity of hair collected by the spool 56 increases. Once the braking torque exceeds the drive torque transferred to the brushbar 6 by the brushbar motor, the brushbar 6 stalls (i.e. stops rotating). The hair then needs to be removed from the spool 56.

The first end cap 24 is removed from the end of the housing 8 together with the first bearing 28, bearing retainer 30 and first brushbar mount 32 (and seals 34). The brushbar 6 is then removed through an aperture in the first side portion 20 along the rotational axis X, thereby exposing the mounting portion 36, drive housing mount 38, drive housing 40, second bearing 42 and second brushbar mount 44.

Figure 3:
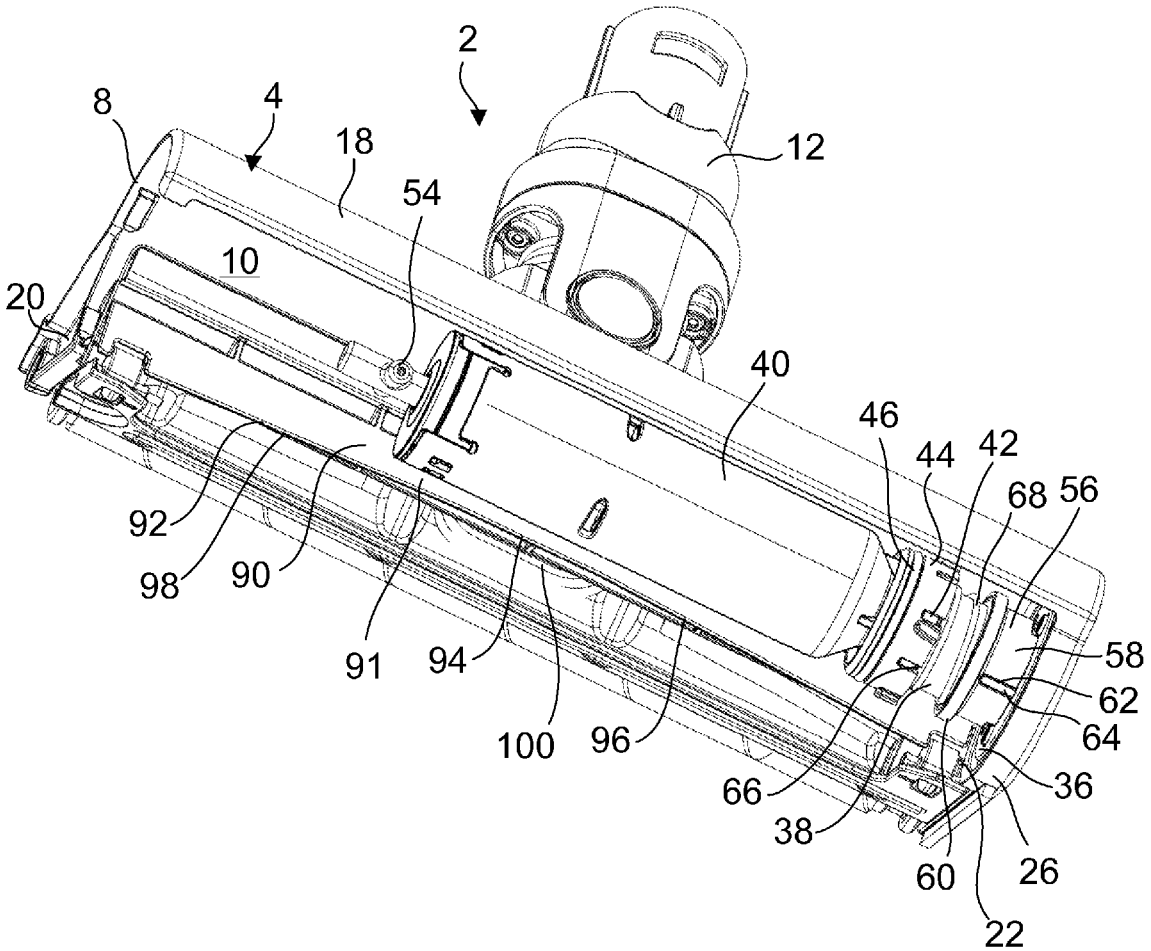
FIG. 3 is a perspective view of part of the cleaner head shown in FIG. 1 in a first configuration.

FIG. 3 shows the cleaner head 2 in a first configuration in which the brushbar 6 has been removed and the spool 56 is in the collecting position.

Figure 4:
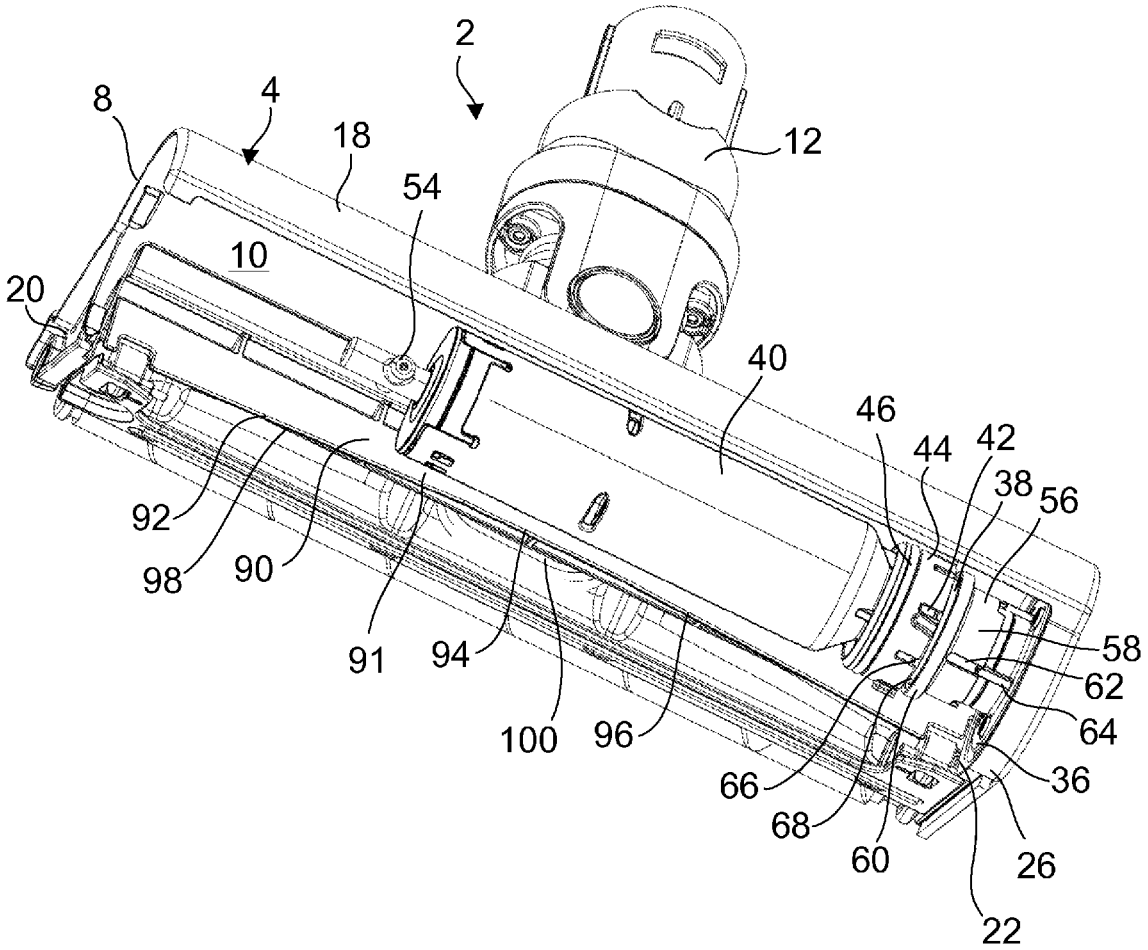
FIG. 4 is a perspective view of part of the cleaner head shown in FIG. 1 in a second configuration.

FIG. 4 corresponds to FIG. 3, but shows the cleaner head 2 in a second configuration in which the spool 56 is in the removal position (i.e. the position in which hair can be removed from the spool 56 as described above). The spool 56 is pushed into the removal position shown in FIG. 4 by sliding the spool 56 along the mounting portion 36. The stiffness of the spring 68 is such that the spool 56 can be manually moved into the removal position by a user, for example by using fingers. In the removal position, the spring 68 is compressed by the spool 56 against the circumferential rib 66 on the drive housing mount 38.

With the spool 56 in the removal position it is readily accessible to a user. In addition, a cutting element such as a pair of scissors or a knife, can be inserted into one of the slots 62 to cut the hair strands from the spool 56. This allows the hair to be cut-away from the spool 56 readily. Alternatively, the bale of hair could be slid from the outer surface 58 of the spool 56 by sliding the bale of hair from spool 56 onto the ribs 64. The hair could then be cut by inserting a cutting implement between the ribs 64. It will be appreciated that the cleaner head 2 could be modified to increase the range of movement of the spool 56 in order to increase the space between the spool 56 and the second side portion 22 in the removal position so that hair that has been slid onto the ribs 64 can be cut-away easily.

Once the hair has been removed, the spool 56 is released. The spring 68 urges the spool 56 back into the collecting position. The cleaner head 2 can then be reassembled by inserting the brushbar 6 into the chamber 10 over the drive housing 40, and the first end cap 24 replaced.

Figure 5:
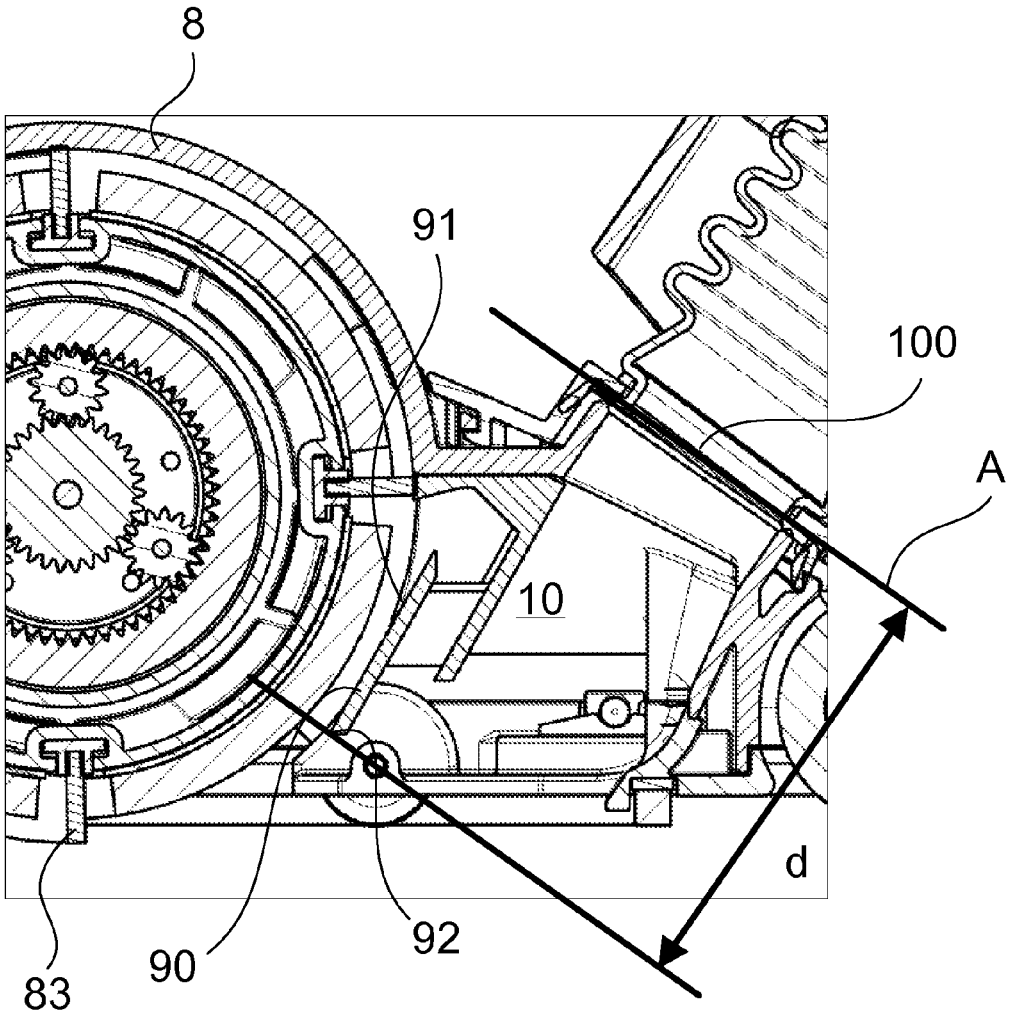
FIG. 5 is a cross-sectional view of part of a cleaner head corresponding to that shown in FIG. 1.

Referring to FIGS. 3, 4 and 5, the cleaner head 2 further comprises a scraper 90 disposed within the chamber 10 and arranged to extend laterally with respect to the cleaner head 2. The scraper 90 is fixed to an upper part of the housing 8 and extends downwardly within the chamber 10. The scraper 90 is inclined slightly forwardly from the upper part of the housing towards the front of the cleaner head 2 and extends in a plane that is tangential with the brushbar 6. The scraper 90 has a planar front surface 91 and a lower working edge 92 that extends in the longitudinal direction of the brushbar 6 (in particular, the working edge 92 extends in a plane which is parallel with the rotational axis X of the brushbar 6). The working edge 92 is arranged to contact the bristles 83 swept past the scraper 90 as the brushbar 6 is rotated such that debris entrained by the brushbar 6 is scraped by the scraper 90 from the bristles 83.

The working edge 92 is a profiled edge comprising a central section 94 and first and second lateral sections 96, 98. Each section 94, 96 and 98 is straight. Each section 94, 96, 98 is relatively smooth (i.e. the sections 94, 96, 98 do not have serrations, notches or protrusions that would inhibit sliding of debris along each section 94, 96, 98). The central section 94 is disposed adjacent a dirty air outlet 100 from the chamber 10. The dirty air outlet 100 is positioned rearwardly and above the working edge 92 and extends in a transversely extending plane A, as shown in FIG. 5.

The central section 94 extends in a direction which is substantially parallel with the rotational axis X of the brushbar 6 and plane A. The first and second sections 96, 98 extend from opposing sides of the chamber 10 towards the central section 94. Both the first and second sections 96, 98 are inclined upwardly within the chamber 10 from the ends which are furthest from the central section 94 towards the central section 94.

The distance d of the working edge 92 from the plane A in which the outlet 100 extends in a direction which is perpendicular to the plane A varies along each of the first and second lateral sections 96, 98. In particular, the distance d of the first section 96 from the plane A decreases along the first section 96 with respect to a direction which is generally towards the outlet 100. Similarly, the distance d of the second section 98 from plane A decreases along the second section 98 with respect to a direction which is generally towards the outlet 100.

Debris, such as strands of hair, threads, lint or fluff, caught on the bristles 84 of the brushbar 6 is intercepted by the working edge 92 of the scraper 90 and scraped from the bristles 84. The debris may, in some instances, slide over the working edge 92 immediately. However, some debris is expected to become caught on the working edge 92.

The airflow though the cleaner head 2 exerts a force on debris caught on the working edge 92 in the direction of the dirty air outlet 100. The inclination of the first and second sections 96, 98 means that a substantial component of the force exerted by the airflow on the debris caught on either of the first and second lateral sections 96, 98 is in the respective directions in which the sections 96, 98 extend. Consequently, a relatively large force is exerted on the debris in the direction of the outlet 100. The smoothness of the lateral sections 96, 98 ensures that the debris is drawn along either the first or second section 96, 98 towards the central section 94 and the dirty air inlet 100.

It is expected that the force exerted by the airflow increases as the debris gets closer to the outlet 100. Therefore, in most circumstances, the force exerted on the debris as it reaches the central section 94 will be sufficient to release the debris caught on the working edge 92 so that it can be sucked through the air outlet 100.

The profiled working edge 92 enhances the removal of debris scraped from the brushbar 6 by the scraper 90 by providing low resistance to debris that is drawn along the working edge 92 towards the outlet 100.

In an alternative embodiment, the first and second sections of the working edge meet adjacent the outlet such that they form an inverted V-shape. The central section would then not be required.

In a further embodiment, the working edge of the scraper is curved. The working edge may curve upwardly from one or both of the lateral sides of the cleaner head towards the outlet. The curvature of the working edge may be concave.

The invention claimed is:

1. A cleaner head for a cleaning appliance, comprising:

a brushbar;

a housing defining a chamber which at least partially surrounds the brushbar, the chamber having a dirty air inlet and a dirty air outlet; and a scraper having a working edge which extends in the longitudinal direction of the brushbar, the scraper is arranged such that, as the brushbar rotates, the working edge scrapes debris entrained by the brushbar from the brushbar, wherein the working edge has a profile which is shaped such that debris which accumulates at the working edge is drawn by the airflow through the cleaner head along the working edge towards the dirty air outlet.

2. The cleaner head of claim 1, wherein the scraper extends in a generally downward direction within the housing such that the working edge forms a lower edge of the scraper.

3. The cleaner head of claim 2, wherein the scraper is inclined downwardly and forwardly within the housing.

4. The cleaner head of claim 1, wherein the dirty air outlet extends in a plane which extends transversely with respect to the cleaner head and the distance of the working edge from the plane in a direction which is perpendicular to the plane varies along the working edge.

5. The cleaner head of claim 4, wherein the distance of the working edge from the plane increases along the working edge with respect to a direction which extends away from the dirty air outlet.

6. The cleaner head of claim 4, wherein the working edge is inclined with respect to the plane in which the dirty air outlet extends.

7. The cleaner head of claim 6, wherein the working edge follows a straight line.

8. The cleaner head of claim 1, wherein the working edge follows a curved line.

9. The cleaner head of claim 1, wherein the working edge is arranged such that, when the cleaner head is placed on a flat surface to be cleaned, the distance of the working edge from the surface in a direction which is perpendicular to the surface varies along the working edge.

10. The cleaner head of claim 1, wherein the dirty air outlet is positioned centrally with respect to the transverse direction of the cleaner head.

11. The cleaner head of claim 1, wherein the scraper is positioned rearwardly of the brushbar.

12. The cleaner head of claim 1, wherein the scraper is rigid.

13. The cleaner head of claim 1, wherein the scraper extends in a plane which is tangential to the brushbar.

14. The cleaner head of claim 1, wherein the scraper is arranged such that the working edge opposes the direction of rotation of the brushbar.

15. A cleaning appliance comprising the cleaner head of claim 1.

* * * * *